US012312729B2

(12) United States Patent
Zhang et al.

(10) Patent No.: US 12,312,729 B2
(45) Date of Patent: May 27, 2025

(54) BALANCE ASSEMBLY AND HOUSEHOLD APPLIANCE

(71) Applicants: GUANGDONG MIDEA WHITE HOME APPLIANCE TECHNOLOGY INNOVATION CENTER CO., LTD., Foshan (CN); MIDEA GROUP CO., LTD., Foshan (CN)

(72) Inventors: Junge Zhang, Foshan (CN); Shuyun Wu, Foshan (CN); Xinjian Huang, Foshan (CN); Su Zhang, Foshan (CN); Yuehui Wang, Foshan (CN)

(73) Assignees: GUANGDONG MIDEA WHITE HOME APPLIANCE TECHNOLOGY INNOVATION CENTER CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 213 days.

(21) Appl. No.: 17/789,213

(22) PCT Filed: Dec. 14, 2020

(86) PCT No.: PCT/CN2020/136236
§ 371 (c)(1),
(2) Date: Jun. 26, 2022

(87) PCT Pub. No.: WO2021/135912
PCT Pub. Date: Jul. 8, 2021

(65) Prior Publication Data

US 2022/0389635 A1 Dec. 8, 2022

(30) Foreign Application Priority Data

Dec. 31, 2019 (CN) ..... 201911415572.5
Dec. 31, 2019 (CN) ..... 201922500716.9

(51) Int. Cl.
*D06F 37/22* (2006.01)
*D06F 33/48* (2020.01)
(Continued)

(52) U.S. Cl.
CPC ..... *D06F 37/22* (2013.01); *D06F 33/48* (2020.02); *D06F 33/76* (2020.02); *D06F 37/225* (2013.01); *D06F 2103/26* (2020.02)

(58) Field of Classification Search
CPC ..... D06F 33/48; D06F 33/76; D06F 37/22; D06F 2103/26
See application file for complete search history.

(56) References Cited

U.S. PATENT DOCUMENTS 4,117,742 A * 10/1978 Stein ..... G01M 1/36 368/171
5,813,253 A * 9/1998 Uhlin ..... D06F 37/225 74/572.4
(Continued)

FOREIGN PATENT DOCUMENTS

CN 102101251 A 6/2011
CN 102767065 A 11/2012
(Continued)

OTHER PUBLICATIONS

ISR mailed Mar. 12, 2021 for PCT Application No. PCT/CN2020/136236.
(Continued)

*Primary Examiner* — Joseph L. Perrin
(74) *Attorney, Agent, or Firm* — K&L Gates LLP

(57) ABSTRACT

Provided are a balance assembly and a household appliance. The balance assembly is applied in the household appliance. The balance assembly includes a balancing ring, a balancer, an identification member and a first detection member. The balancing ring has a chamber defined therein. The balancer
(Continued)

is movably arranged in the chamber and includes a rotating member and a driving member. The driving member is connected to the rotating member and configured to drive the rotating member to rotate to drive a movement of the balancer within the chamber. A relative movement between the first detection member and the identification member occurs during the movement of the balancer. The first detection member is to detect a number of times of the identification member passing through the first detection member. The number of times of the identification member passing through the first detection member is related to a position of the balancer.

16 Claims, 8 Drawing Sheets

(51) Int. Cl.
*D06F 33/76* (2020.01)
*D06F 103/26* (2020.01)

(56) References Cited

U.S. PATENT DOCUMENTS 6,510,715 B1 * 1/2003 Simsek ..... D06F 33/48 74/572.4
2012/0192362 A1 * 8/2012 Lee ..... D06F 37/225 8/137
2012/0278996 A1 * 11/2012 Park ..... D06F 34/16 74/572.4
2013/0327098 A1 * 12/2013 Bae ..... D06F 33/47 74/572.4
2013/0327099 A1 * 12/2013 Bae ..... F16F 15/32 74/574.1
2015/0354123 A1 * 12/2015 Kim ..... D06F 37/225 68/23.2
2018/0291547 A1 10/2018 Moon et al.

FOREIGN PATENT DOCUMENTS

CN 102782201 A 11/2012
CN 103485129 A 1/2014
CN 103726269 A 4/2014
CN 105624972 A 6/2016
CN 211395010 U 9/2020
CN 211395022 U 9/2020
CN 211395025 U 9/2020
EP 2719806 A2 4/2014
EP 2955263 A1 12/2015
EP 3252201 A1 12/2017
EP 3388569 A1 10/2018
KR 20110010945 A 2/2011
WO 2013183960 A1 12/2013

OTHER PUBLICATIONS

1st OA and 1st Search Report issued Nov. 3, 2021 of CN Application No. 201911415572.5.
2nd OA issued May 11, 2022 of CN Application No. 201911415572.5.
Extended European Search Report issued Jan. 4, 2023 regarding EP Application No. 20910335.7.

* cited by examiner

BALANCE ASSEMBLY AND HOUSEHOLD APPLIANCE

CROSS-REFERENCES TO RELATED APPLICATIONS

The present disclosure is a national phase application of International Application No. PCT/CN2020/136236, filed on Dec. 14, 2020, which claims a priority to and the benefit of Chinese Patent Application No. 201911415572.5 and Chinese Patent Application No. 201922500716.9, filed with China National Intellectual Property Administration on Dec. 31, 2019, the entireties of which are herein incorporated by reference.

FIELD

The present disclosure relates to the field of household appliances, and more particularly, to a balance assembly and a household appliance.

BACKGROUND

When a cavity of a household appliance rotates and the load is eccentric, there will be serious vibration. In the related art, a balancing ring is disposed on the cavity, and the balancing ring has a built-in movable balancer for balancing the eccentricity of the load. By controlling the movement of the balancer in the balancing ring, the vibration generated by the eccentricity of the load may be balanced. In order to achieve the above goals, it is necessary to detect the position of the balancer.

SUMMARY

Embodiments of the present disclosure provide a balance assembly and a household appliance.

Embodiments of the present disclosure provide a balance assembly applied in a household appliance. The balance assembly includes a balancing ring, a balancer, an identification member, and a first detection member. The balancing ring has a chamber defined therein. The balancer is movably arranged in the chamber, and includes a rotating member and a driving member. The driving member is connected to the rotating member and is configured to drive the rotating member to rotate to drive a movement of the balancer within the chamber. The balance assembly is configured to cause a relative movement between the identification member and the first detection member during the movement of the balancer. The first detection member is configured to detect a number of times of the identification member passing through the first detection member. The number of times of the identification member passing through the first detection member is related to a position of the balancer.

Embodiments of the present disclosure provide a household appliance. The household appliance includes a cavity having a rotation axis, and the balance assembly according to any one of the above embodiments. The balance assembly is mounted in the cavity. A central axis of the balancing ring is parallel to or coincident with the rotation axis of the cavity.

Additional embodiments of the present disclosure will be set forth, in part, from the following description, and in part will be apparent from the following description, or may be learned by practice of the present disclosure.

BRIEF DESCRIPTION OF THE DRAWINGS

The embodiments of the present disclosure will become apparent and readily understood from the following description of embodiments taken in conjunction with the accompanying drawings, in which.

Figure 1:
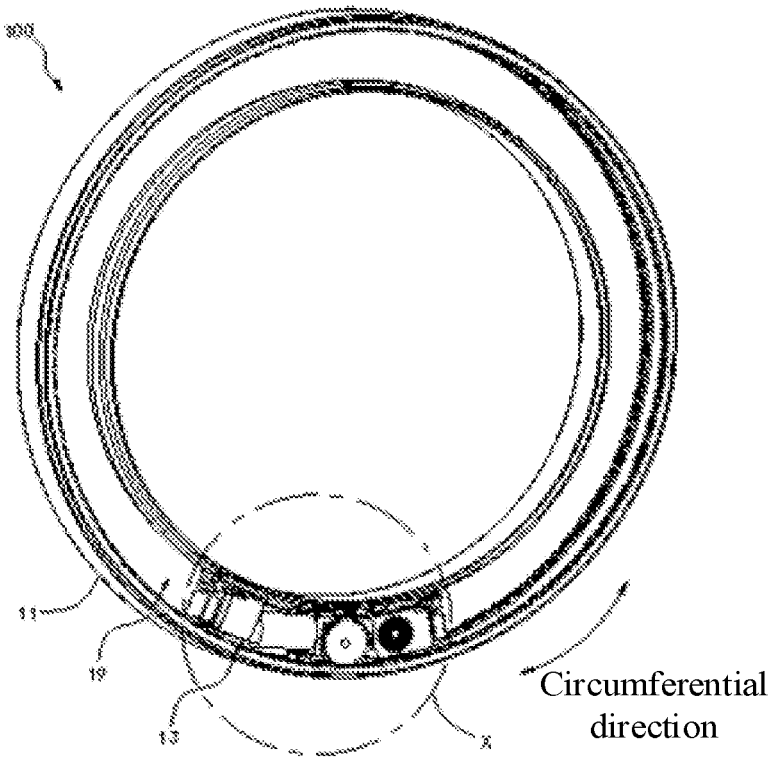
FIG. 1 is a perspective schematic diagram of a balance assembly according to an embodiment of the present disclosure.

SYMBOLS OF MAIN COMPONENTS balance assembly 100, household appliance 200;

balancing ring 11, balancer 13, identification member 15, first detection member 17, chamber 19, initial position 191;

rotating member 21, gear 22, driving member 23, first inner wall 25, second inner wall 27, ring gear portion 29;

first guide member 33, second guide member 35, mounting member 36, connecting member 37, elastic member 38, bracket 39;

calibration member 41, calibration portion 42, second detection member 43, roller 45, bearing member 47, power supply apparatus 48; and main controller 50, cavity 51, outer drum 53, vibration damping structure 54, and mounting plate 55.

DETAILED DESCRIPTION OF THE DISCLOSURE

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are merely illustrative and are intended to explain, rather than limiting, the present disclosure.

In the description of the present disclosure, terms such as "first" and "second" are used herein for purposes of description and are not intended to indicate or imply relative importance, or to implicitly show a number of features indicated. Thus, a feature defined with "first" and "second" may explicitly or implicitly includes one or more this feature. In the description of the present disclosure, "a plurality of" means two or more, unless specified otherwise.

In the present disclosure, unless otherwise clearly specified and limited, terms such as "install", "connect", "connect to" and the like should be understood in a broad sense. For example, it may be a fixed connection or a detachable connection or connection as one piece; mechanical connection or electrical connection; direct connection or indirect connection through an intermediate; internal communication of two components or the interaction relationship between two components, unless otherwise clearly limited. The specific meaning of the above terms in the present disclosure can be understood according to specific circumstances.

Different embodiments or examples are provided by the disclosure of the present disclosure for implementing structures of the present disclosure. In order to simplify the disclosure of the present disclosure, components and arrangements of specific examples are provided below. Of course, the components and arrangements are merely illustrative and are not intended to limit the present disclosure. Furthermore, reference numerals and/or reference letters may be repeatedly used in different examples of the present disclosure for a purpose of simplification and clearness, instead of indicating relationships between various embodiments and/or arrangements discussed herein. In addition, the present disclosure provides examples of various specific processes and materials, but the applicability of other processes and/or application of other materials.

Figure 2:
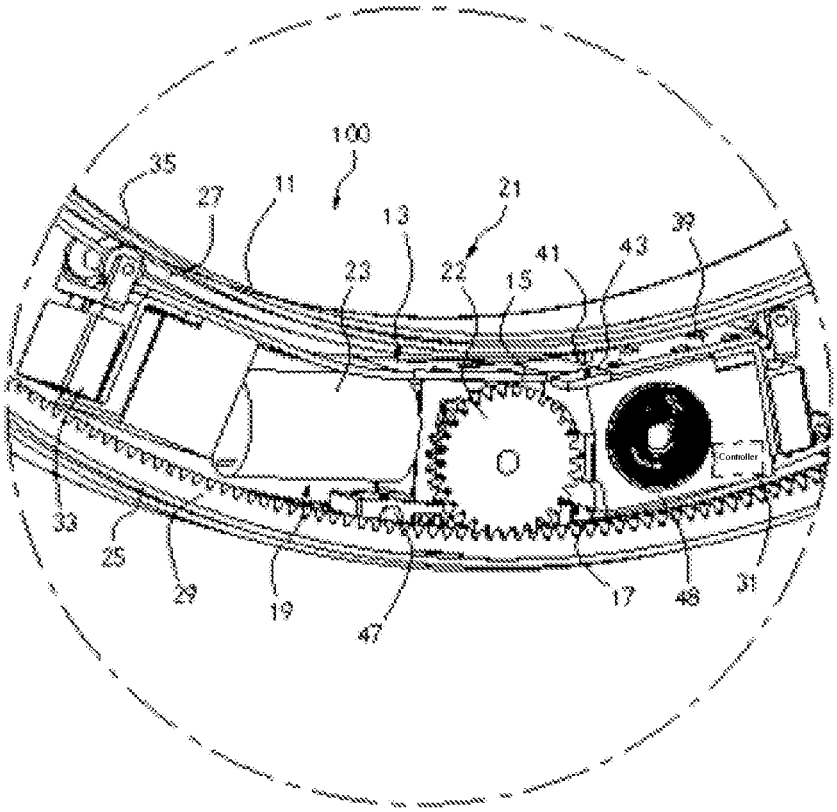
FIG. 2 is an enlarged view of part X of the balance assembly of FIG. 1.
Figure 11:
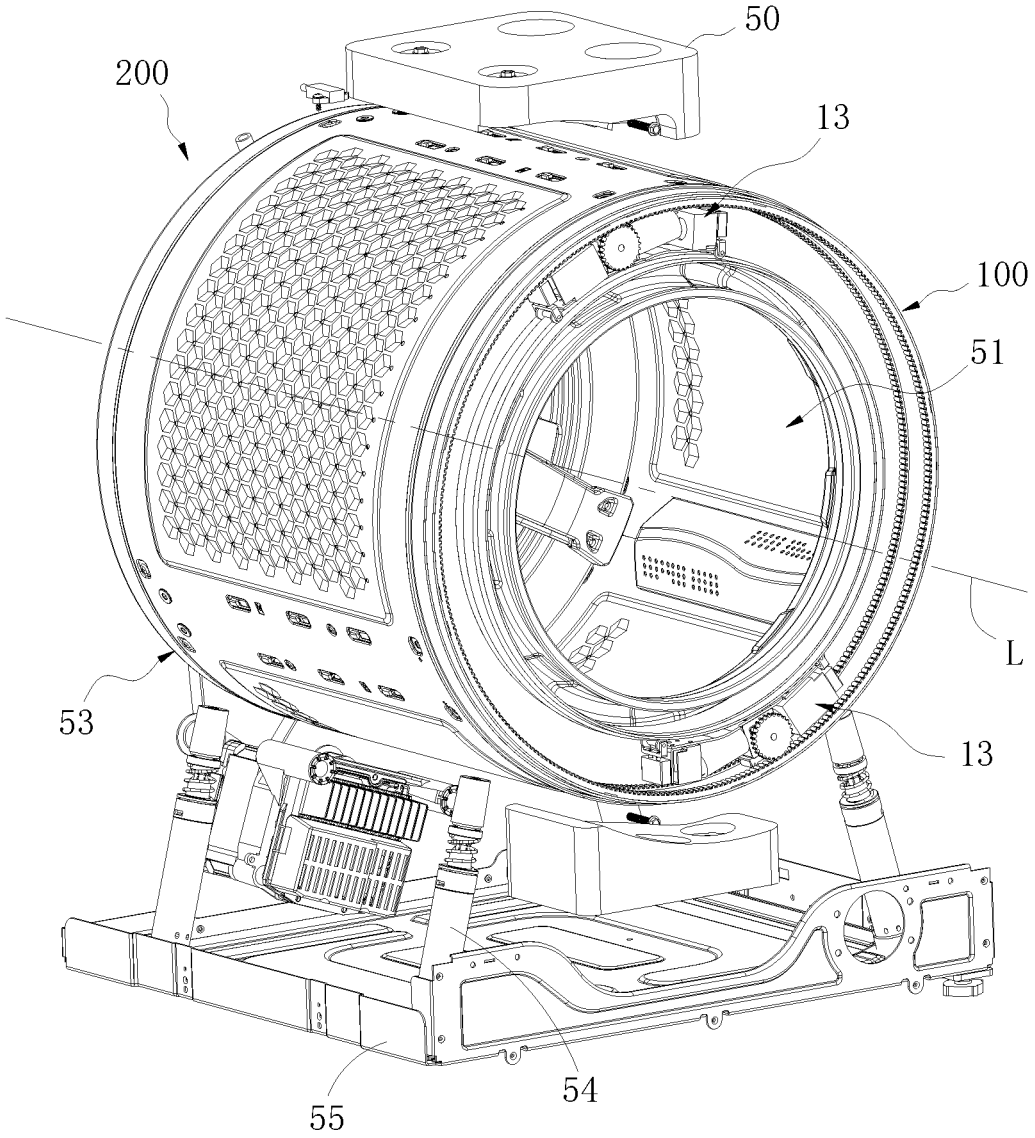
FIG. 11 is a perspective schematic diagram of a household appliance according to an embodiment of the present disclosure.

Referring to FIG. 1 and FIG. 2, a balance assembly 100 provided by an embodiment of the present disclosure is applied in a household appliance 200 (in conjunction with FIG. 11). The balance assembly 100 includes a balancing ring 11, a balancer 13, an identification member 15, and a first detection member 17. The balancing ring 11 has a chamber 19 defined therein. The balancer 13 is movably arranged in the chamber 19 and includes a rotating member 21 and a driving member 23. The driving member 23 is connected to the rotating member 21 and is configured to drive the rotating member 21 to rotate to drive a movement of the balancer 13 within the chamber 19. The balance assembly 100 is configured to cause a relative movement between the identification member 15 and the first detection member 17 during the movement of the balancer 13. The first detection member 17 is configured to detect a number of times of the identification member 15 passing through the first detection member 17, and the number of times of the identification member 15 passing through the first detection member 17 is related to a position of the balancer 13.

In the above balance assembly 100, the rotating member 21 may drive a movement of the balancer 13 within the chamber 19. The first detection member 17 may detect the number of times of the identification member 15 passing through the first detection member 17, and the number of times of the identification member 15 passing through the first detection member 17 may be used to determine the position of the balancer 13.

It can be understood that, in the embodiment of the present disclosure, during the movement of the balancer 13 within the chamber 19, the identification member 15 and the first detection member 17 move relative to each other, and the identification member 15 passes through the first detection member 17. The number of times of the identification member 15 passing through the first detection member 17 is related to the position of the balancer 13. Therefore, the moving distance of the balancer 13 may be determined by detecting the number of times of the identification member 15 passing through the first detection member 17, and the position of the balancer 13 may be determined in combination with an initial position 191 of the balancer 13. The initial position 191 may refer to a position where the balancer 13 is located before it begins to move within the chamber 19, or a position that can be determined during the movement of the balancer 13.

In the illustrated embodiment, the balancing ring 11 defines a chamber 19 along the circumferential direction, and the balancer 13 may move back and forth within the chamber 19 along the circumferential direction. That is, the balancer 13 may make a circular motion in the chamber 19 of the balancing ring 11. Referring to FIG. 2, in the illustrated embodiment, the driving member 23 is connected to the rotating member 21, and the driving member 23 drives the rotating member 21 to rotate on the inner wall of the chamber 19, to drive a movement of the balancer 13 within the chamber 19.

In some embodiments, the rotating member 21 has an identification member 15 disposed thereon, or the chamber 19 has an identification member 15 disposed on an inner wall thereof. In this way, the identification member 15 can be detected in various manners, and thus the flexibility of the identification member 15 during mounting can be improved.

Further, referring to FIG. 2, in the illustrated embodiment, the identification member 15 is disposed on the rotating member 21. In some embodiments, the rotating member 21 includes a gear 22. The chamber 19 includes a first inner wall 25, and the first inner wall 25 has a ring gear portion 29 disposed thereon. The gear 22 meshes with the ring gear portion 29. The identification member 15 is a tooth of the gear 22 or a tooth of the ring gear portion 29. In this way, the tooth of the gear 22 can be used as the identification member 15, without requiring a separate identification member 15. It can be understood that, in other embodiments, the identification member 15 may also be the tooth of the ring gear portion 29.

There are grooves between the teeth of the gear 22 or between the teeth of the ring gear portion 29, and the teeth and the grooves are evenly and alternately distributed. The gear 22 meshes with the ring gear portion 29 to rotate. When the gear 22 rotates, the balancer 13 may be driven to move relative to the ring gear portion 29. In this case, the teeth of the gear 22 or the teeth of the ring gear portion 29 may serve as the identification member 15, and correspondingly, the first detection member 17 may be mounted on the balancer 13. The first detection member 17 includes a detection surface, and the detection surface faces the identification member 15. When the teeth of the gear 22 are used as the identification member 15, the rotating member 21 has the identification member 15 disposed thereon. When the teeth of the ring gear portion 29 arranged on the first inner wall 25 are used as the identification member 15, the first inner wall 25 of the chamber 19 has the identification member 15. In other embodiments, the identification member 15 may be disposed in a position other than the first inner wall 25 in the chamber 19.

In some embodiments, when the identification member 15 is the tooth of the gear 22, the first detection member 17 may be mounted on the balancer 13 at a position directly facing the tooth of the gear 22. When the gear 22 rotates, the first detection member 17 is relatively stationary. When the identification member 15 is the tooth of the ring gear portion 29, the first detection member 17 may be mounted on the balancer 13 at a position directly facing the tooth of the ring gear portion 29. When the gear 22 rotates, the balancer 13 moves and thus drives a movement of the first detection member 17 relative to the ring gear portion 29. During the rotation of the gear 22, the tooth of the gear 22 will continuously pass through the first detection member 17. Therefore, the number of times of the tooth of the gear 22 passing through the first detection member 17, that is, the number of the teeth of the gear 22 passing through the first detection member 17, may be detected.

In addition, the gear 22 meshes with the ring gear portion 29 to drive the movement of the balancer 13, and thus a slipping of the balancer 13 is prevented during the movement process to ensure the stability of the movement of the balancer 13.

In some embodiments, the first detection member 17 may include at least one of an optical sensor, a Hall sensor, or an ultrasonic sensor. In this way, the first detection member 17 has selectivity and lower cost. The optical sensor may be, for example, an infrared sensor or the like.

In some embodiments, when the first detection member 17 includes one type of sensor, one of the optical sensor, the Hall sensor, and the ultrasonic sensor may be selected. When the first detection member 17 includes multiple types of sensor, two or more types of the optical sensor, the Hall sensor, or the ultrasonic sensor may be selected. The data detected by two or more sensors may be averaged as the output data of the first detection member 17, or the data may be calculated with different weights or ratios to serve as the output data of the first detection member 17.

It can be understood that with the development of technology, the manufacturing processes of the optical sensors, the Hall sensors, the ultrasonic sensors, etc. have been quite mature. Thus, the above types of sensors have smaller size and the manufacturing cost thereof is low, and they can be massively produced and suitable for being applied to the balance assembly 100. By selecting the above types of sensors as the first detection member 1, the detection function of the identification member 15 can be achieved, while reducing the manufacturing cost of the balance assembly 100.

Figure 3:
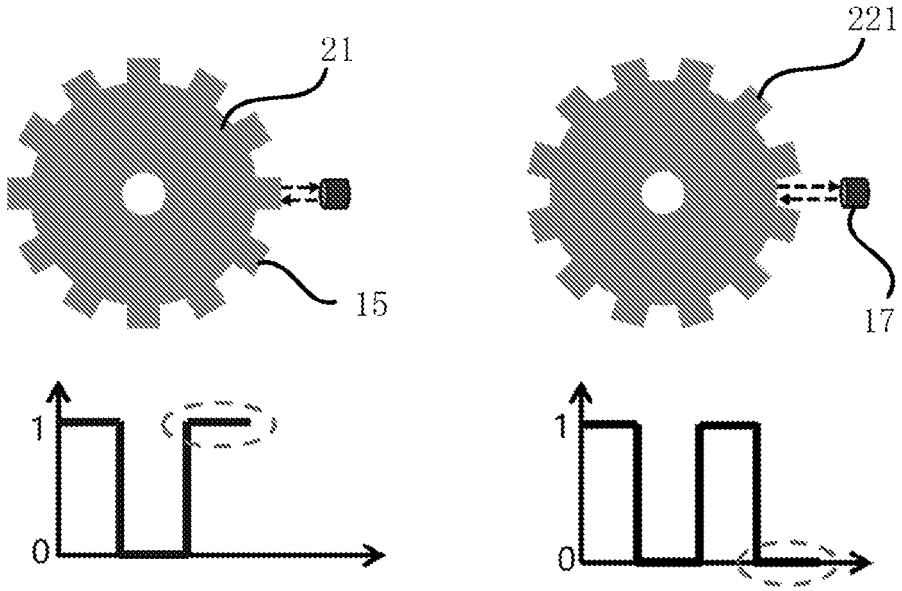
FIG. 3 is a schematic diagram of a detection principle of a first detection member according to an embodiment of the present disclosure.

In the embodiment of FIG. 3, the identification member 15 is the tooth of the gear 22, and the first detection member 17 is an optical sensor, which can transmit and receive optical signals. Since a distance between the tooth of the gear 22 and the optical sensor is different from a distance between the groove of the gear 22 and the optical sensor, an intensity of the optical signal received by the optical sensor reflected by the tooth is different from that reflected by the groove. Through processing, a regular pulse signal may be obtained. The position of the balancer 13 can be obtained based on the number of pulses, i.e., the number of the teeth rotated by the gear 22, from which the moving distance of the balancer 1 can be obtained, in combination with the initial position 191 of the balancer 13. The optical sensor may be an infrared sensor. The mechanism of the ultrasonic sensor is similar to that of the optical sensor, which will not be repeated herein.

Figure 4:
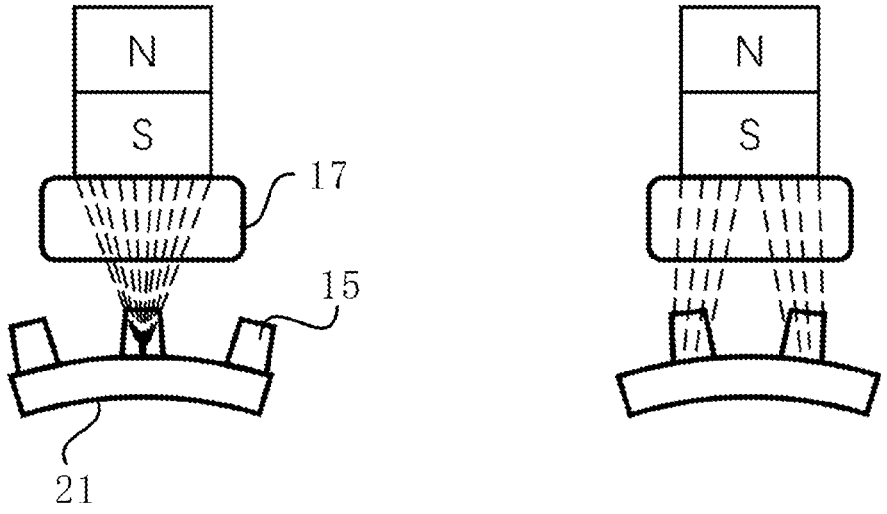
FIG. 4 is a schematic diagram of another detection principle of a first detection member according to an embodiment of the present disclosure.

In the embodiment of FIG. 4, the identification member 15 is a tooth of the gear 22, and the first detection member 17 is a Hall sensor. Since the tooth and groove will affect the direction of the magnetic field lines of the Hall sensor, the density of the magnetic field lines passing through the Hall sensor will be changed. When the gear 22 rotates, the Hall sensor will output regular pulse signals. Based on the pulse signals, the number of the teeth in the rotation of the gear 22 can be calculated. Thus, the moving distance of the balancer 13 may be obtained, and in combination with the initial position 191 of the balancer 13, the position of the balancer 13 may be obtained.

In other embodiments, the identification member 15 may be black and white stripes, and the first detection member 17 may be an optical sensor. The black and white stripes may be arranged on the gear 22, or on the part that rotates coaxially with the gear 22, or arranged on the inner wall of the chamber 19 to form a ring and concentrically with the ring gear portion 29. The optical sensor may be mounted on the balancer 13 at a position facing the black and white stripe. Since the black stripe absorbs light and the white stripe reflects light, during the movement of the balancer 13, the black and white stripes will continuously pass through the optical sensor. Therefore, the number of times of white stripes passing through the optical sensor, that is, the number of white stripes passing through the optical sensor, may be detected. Based on the optical signal received by the optical sensor, the regular pulse signals may be obtained, and the number of pulses is the number of the white stripes by which the balancer 13 rotates. Since the widths of the white stripes and the black stripes are known, the moving distance of the balancer 13 can be obtained, and thus, in combination with the initial position 191 of the balancer 13, the position of the balancer 13 may be obtained.

It should be noted that the above identification member 15 may also have other structures. For example, the rotating member 21 may be a wheel having spokes at intervals, and the identification member 15 may be a spoke of the wheel. The first detection member 17 may detect the number of times that the spoke passes through the first detection member 17. The specific detection mechanism is similar to the above.

Figure 5:
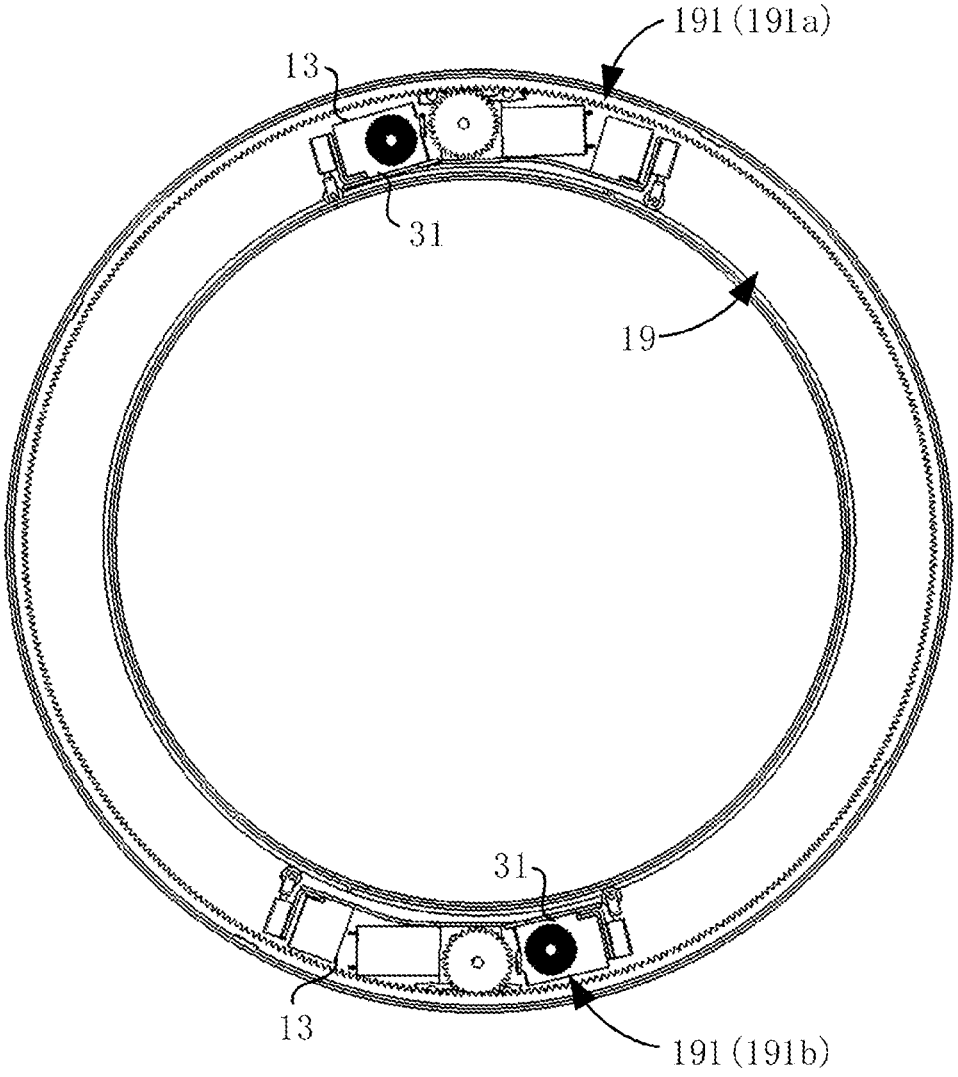
FIG. 5 is a schematic diagram of a balancer in an initial position according to an embodiment of the present disclosure.

Referring to FIG. 2 and FIG. 5, in some embodiments, the chamber 19 has an initial position 191. The balance assembly 100 includes a controller 31, and the controller 31 is electrically connected to the first detection member 17. The controller 31 is configured to determine a position of the balancer 13 based on the initial position 191 and the number of times of the identification member 15 passing through the first detection member 17. In this way, it is convenient to determine the position where the balancer 13 is located.

It can be understood that the initial position 191 of the balancer 13 refers to a default position when the balancer 13 is stationary in the chamber 19 when the balancer 13 does not move. The controller 31 records the initial position 191, and determines the position of the balancer 13 in combination with the moving distance the balancer 13 when the balancer 13 starts to move from the default position. In some embodiments, the first detection member 17 may output regular pulse signals based on the number of times of the identification member 15 passing through the first detection member 17. The pulse signals output by the first detection member 17 are received and processed by the controller 31 to obtain, in combination with the initial position 191 of the balancer 13, the moving distance of the balancer 13. In this way, the specific position of the balancer 13 may finally be calculated. The controller 31 may be a controller of the balancer 13. The balancer has a control board (not shown) mounted thereon, and the controller 31 may be arranged on the control board. The specific position of the balancer 13 may be transmitted to a main controller 50 of the household appliance 200 in a wired or wireless manner. In other embodiments, the controller 31 may also be located outside the balancer 13, for example, at other positions on the balancing ring 11.

It can be understood that, in another embodiment, the balancer 13 may also transmit the number of times of the identification member 15 passing through the first detection member 17 to the main controller 50 of the household appliance 200 in a wireless or wired manner, and the specific position of the balancer 13 is determined by the main controller 50, which is not described in detail herein.

In the embodiments of the present disclosure, there is initial positions 191 in the chamber 19. In a case that balancers 13 is disposed in the chamber 19, one balancer 13 is located in one initial position 191. In an embodiment, there are two initial positions 191 in the chamber 19, and the number of the balancers 13 is two. When the two balancers 13 are not in motion, one balancer 13 remains stationary in one initial position 191. In one embodiment, the two initial positions 191 are symmetrically arranged at 180 degrees. In this way, the balancers 11 can be kept balanced when the balancers 13 are not in motion. In the embodiment illustrated in FIG. 5, there are an initial position 191*a* and an initial position 191*b* in the chamber 19. One balancer 13 is located at each of the initial position 191*a* and the initial position 191*b*. In other embodiments, one, three, or more initial positions 191 may be provide, and the specific positions thereof may be set as required, which is not limited herein.

Referring to FIG. 2, FIG. 6 to FIG. 8, in some embodiments, the balance assembly 100 includes a first guide member 33 and a second guide member 35. The first guide member 33 is disposed on the balancer 13. The chamber 19 has a first inner wall 25, and a second inner wall 27 opposite to the first inner wall 25. The second guide member 35 is disposed on the second inner wall 27. The first guide member 33 is connected to the second guide member 35 to guide the movement of the balancer 13. In this way, the balancer 13 may be guided to stabilize the movement of the balancer 13.

It can be understood that the balancer 13 may vibrate when moving in the chamber 1. Thus, the balancer 13 may deviate from the moving track when moving at a high speed, which may affect the movement of the balancer 13. By providing the first guide member 33 and the second guide member 35, the balancer 13 can move against the second inner wall 27, and thus the balancer 13 is guided to increase the stability of the balancer 13.

Figure 6:
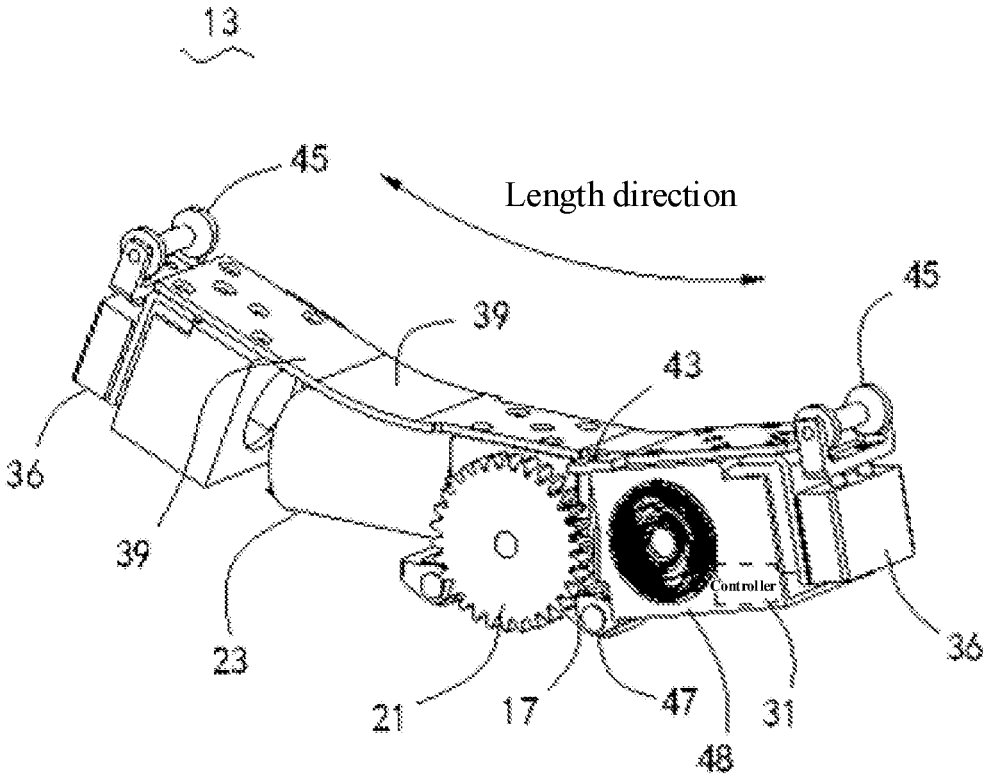
FIG. 6 is a perspective schematic diagram of a balancer according to an embodiment of the present disclosure.
Figure 7:
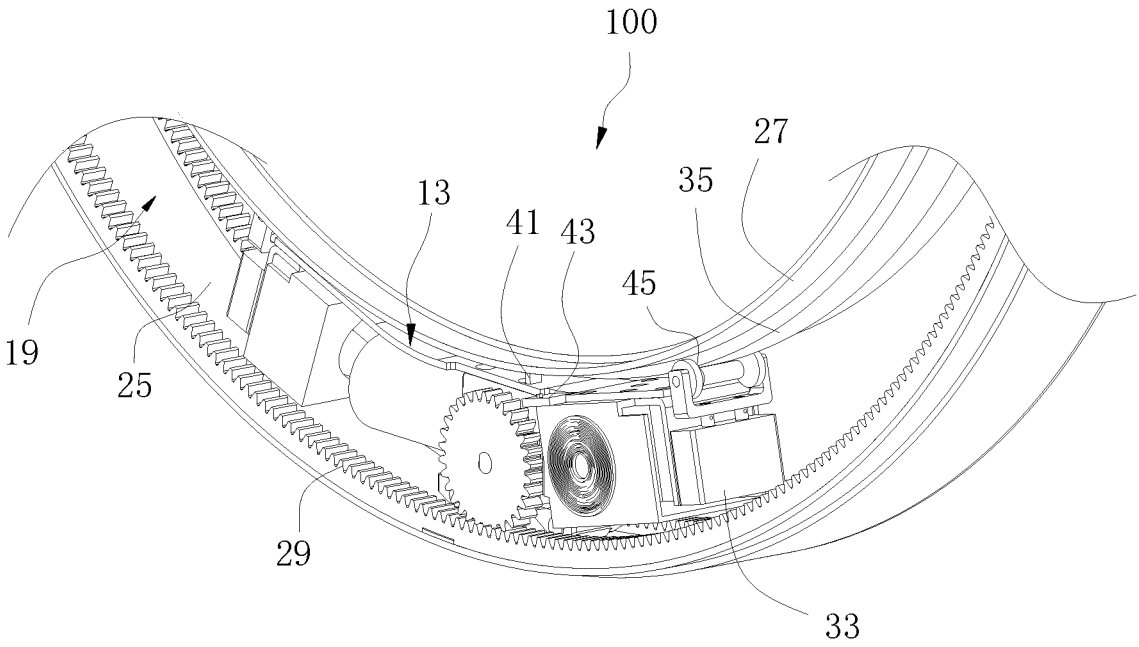
FIG. 7 is a partial structural diagram of a balance assembly according to an embodiment of the present disclosure.
Figure 8:
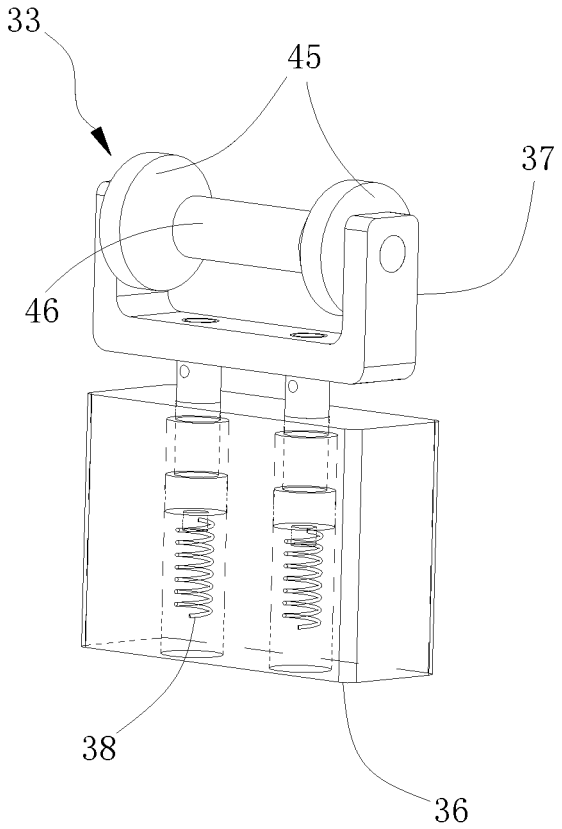
FIG. 8 is a perspective diagram of a first guide member according to an embodiment of the present disclosure.

Referring to FIG. 6 to FIG. 8, in some embodiments, the first guide member 33 includes a roller 45, and the roller 45 is connected to the second guide member 35. In this way, the frictional force between the balancer 13 and the second guide member 35 can be reduced when the balancer 13 is moving.

In the illustrated embodiment, the second guide member 35 is an annular guide rail arranged on the second inner wall 27. In the illustrated embodiment, the first guide member 33 includes two rollers 45 connected by a rotating shaft 46. The two rollers 45 can roll on the guide rail, and the two rollers 45 may clamp the guide rail. Along the length direction of the balancer 13, two first guide members 33 are arranged at both ends of the balancer 13 to further improve the smoothness of the movement of the balancer 13. In other embodiments, the first guide member 33 and the second guide member 35 may be connected to each other by means of embedding, meshing and abutting, and may also play a guiding role. Other embodiments are not described in detail herein.

Further, the first guide member 33 includes a mounting member 36, a connecting member 37, and an elastic member 38. The mounting member 36 has a blind hole for accommodating the elastic member 38 defined therein. One end of the elastic member 38 is connected to the connecting member 37, and the other end of the elastic member 38 abuts against the bottom wall of the blind hole. The roller 45 is rotatably connected to the connecting member 37. The first guide member 33 is mounted on the balancer 13 through the mounting member 36. When the roller 45 is connected to the second guide member 35, the roller 45 may elastically compress the elastic member 38 through the connecting member 37 under the action of an excessively great force between the roller 45 and the second guide member 35. In this way, the elastic member 38 generates an elastic force facing away from the second guide member 35, which buffers the force between the roller 45 and the second guide member 35. Therefore, the friction between the balancer 13 and the second guide member 35 can be reduced to achieve the effect of vibration reduction. At the same time, the elastic member 38 may ensure that the roller 45 is always connected to the second guide member 35. In the illustrated embodiment, the first guide member 33 has two elastic members 38 disposed thereon and connected to the connecting member 37, and thus the mounting member 36 may bear a greater force.

Figure 9:
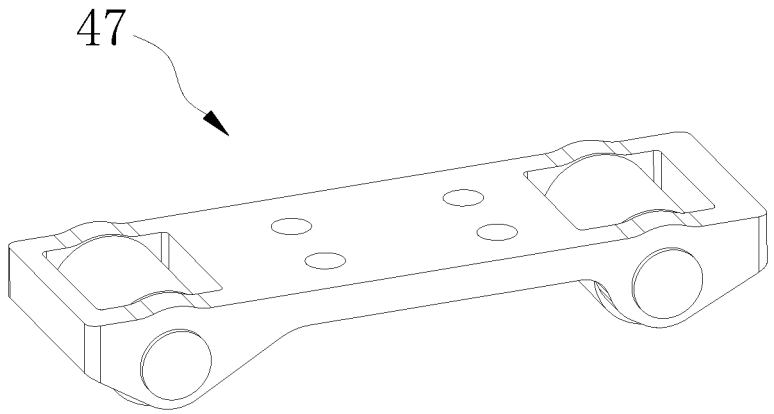
FIG. 9 is a perspective schematic diagram of a bearing member according to an embodiment of the present disclosure.

Referring to FIG. 9 again, the balancer 13 further includes a bearing member 47. The bearing member 47 is fixedly connected to the driving member 23 and is configured to bear the centrifugal force of the circular motion of the balancer 13. The bearing member 47 has sliding wheels. The sliding wheels of the bearing member 47 move along the first inner wall 25 of the chamber 19 during the movement of the balancer 13. In this way, the bearing member 47 may abut against the first inner wall 25 to provide the support force of the first inner wall 25 to the balancer 13. In the illustrated embodiment, in addition to the guiding function of the first guide member 33 and the second guide member 35, the frictional force between the balancer 13 and the first inner wall 25 may be reduced at the same time.

Further, the balancer 13 includes a bracket 39. In some embodiments, the balancer 13 may further include a power supply apparatus 48, and the power supply apparatus 48 can supply power to the balancer 13. The bracket 39 is designed as an arc-shaped structure along the circumferential direction of the chamber 19. The first detection member 17, the driving member 23, the controller 31, the first guide member 33, and the power supply apparatus 48 may all be arranged on the bracket 39. In this way, the balancer 13 may cooperate with the annular structure of the balancing ring 11 to move in the chamber 19 to avoid collision with the inner wall of the chamber 19. The bracket 39 may be made of thick stainless-steel plate, and thus the bracket 39 will not deform during the entire working process of the balancer 13. The power supply apparatus 48 may use a rechargeable battery to power the balancer 13.

Referring to FIG. 2, FIG. 6 and FIG. 7, in some embodiments, the balance assembly 100 includes a calibration member 41 and a second detection member 43. The balance assembly 100 is configured to cause a relative movement between the calibration member 41 and the second detection member 43 during the movement of the balancer 13, and cause the second detection member 43 to detect the calibration member 41 for eliminating a position error of the balancer 13.

It can be understood that, since the balancer 13 moves for a long time, accumulated errors may occur when the first detection member 17 detects the information about the number of times of the identification member 15 passing through the first detection member 17. Therefore, when the moving distance of the balancer 13 is calculated based on the information about the number of times with errors, an error occurs in the determined position of the balancer 13. Therefore, the position error of the balancer 13 may be eliminated by providing the calibration member 41 and the second detection member 43.

In some embodiments, when the second detection member 43 passes through each calibration member 41, the information of the calibration member 41 detected by the second detection member 43 will be transmitted to the controller 31. Further, the controller 31 will set the position of the balancer 13 to a value of 0, that is, it is regarded as the origin to recalculate the moving distance of the balancer 13. In this way, the accumulated distance error caused by the long-term movement of the balancer 13, which may result in the inability to accurately determine the position of the balancer 13, can be avoided. In this embodiment, after the second detection member 43 passes through each calibration member 41, the information about the number of times of the first detection member 17 passing through the identification member 15 will be fed back to the controller 31 from 0 again by means of a pulse signal, and the controller 31 starts to calculate the moving distance of the balancer 13 again and obtains the precise position information of the balancer 11 where the balancer 13 is located.

Figure 10:
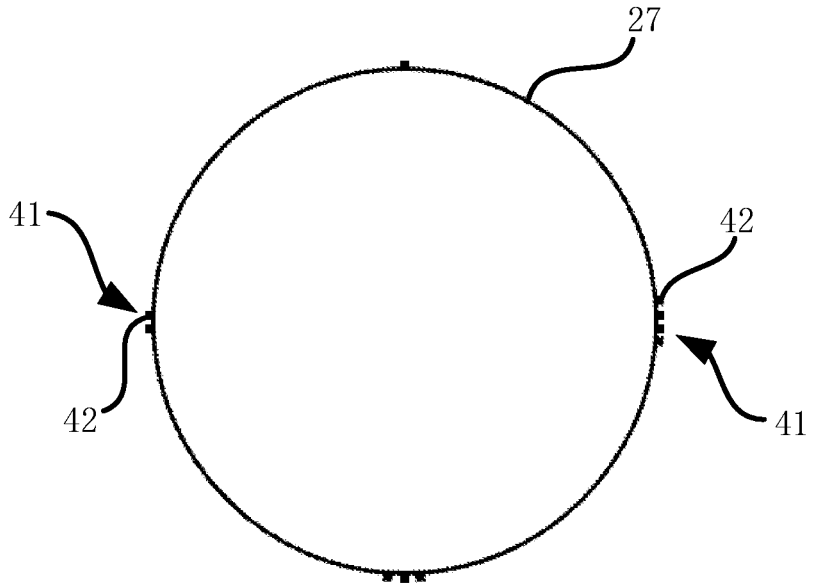
FIG. 10 is a schematic diagram illustrating a distribution of a calibration member according to the embodiment of the present disclosure.

Referring to FIG. 10, calibration members 41 is distributed and arranged at intervals on the inner wall of the chamber 19, such as the second inner wall 27. Each calibration member 41 includes a different number of calibration portions 42. The second detection member 43 may be one of an optical sensor, an ultrasonic sensor, and a Hall sensor. The second detection member 43 may trigger different pulse signals after passing through different numbers of calibration portions 42, and the number of pulses of the pulse signal is the same as the number of calibration portions 42. Thus, it can be determined based on the pulse signal output by the second detection member 43 that the balancer 13 is passing through a calibration member 41, and the specific position of the balancer 13 in the chamber 19 can be determined. In this way, the position of the balancer 13 may be tracked within the chamber 19. In an example, the inner wall of the chamber 19 has a calibration member 41 every 90 degrees, and the number of the calibration portions 42 is one, two, three and four, respectively.

When the second detection member 43 includes an optical sensor, the calibration member 41 may be arranged on the second inner wall 27, and the calibration portion 42 may be a black and white stripe. The optical sensor may transmit an optical signal to the second inner wall 27 and receive the optical signal reflected on the second inner wall 27. When the balancer 13 passes through the calibration member 41, the optical sensor will pass through the black and white stripe to change the intensity of the received optical signal, and thus pulse signals corresponding to the number of the calibration portions 42 can be output. Based on the pulse signals, the number of times of the balancer 13 passing through the calibration portion 42 may be determined, and the current position of the balancer 13 may be determined based on the position of the calibration member 41. In other embodiments, the calibration portion 42 may also be a groove or a protrusion. Depending on the intensity of the optical signal received by the optical sensor, the pulse signals corresponding to the number of the calibration portion 42 can also be obtained to finally determine the current position of the balancer 13. The mechanism of the ultrasonic sensor is similar to that of the optical sensor, and will not be repeated herein.

When the second detection member 43 includes a Hall sensor, the calibration portion 42 may be a protruding structure made of a metal material. It can be understood that, when the balancer 13 passes through the calibration member 41, the calibration member 41 will affect the direction of the magnetic field lines of the Hall sensor to change the density of the magnetic field lines passing through the Hall sensor, and the Hall sensor will output pulse signals corresponding to the number of calibration portions 42. Based on the pulse signals, the number of times of the calibration portion 42 passing through the sensor can be determined, and thus the current position of the balancer 13 can be determined based on the position of the calibration member 41.

It should be noted that, the number and position of the calibration members 41 as well as the number of the calibration portions 42 of the calibration member 41 may be adjusted based on specific conditions, and are not limited to the above embodiments.

In some embodiments, referring to FIG. 2, FIG. 6 and FIG. 7, the first detection member 17 and the second detection member 43 are both disposed on the balancer 13, and the identification member 15 is disposed on the rotating member 21, and the calibration member 41 is disposed on an inner wall of the chamber 19. In this way, the mounting may be facilitated and the structure may be simplified.

In the illustrated embodiment, the rotating member 21 includes a gear 22, and the identification member 15 is a tooth of the gear 22. The calibration member 41 is disposed on the second inner wall 27, and the calibration member 41 is a protrusion. The first detection member 17 is mounted on the balancer 13 at a position facing the identification member 15, and the second detection member 43 is mounted on the balancer 13 at a position facing the second inner wall 27. The first detection member 17 and the second detection member 43 may be of the same type or different types. For example, the first detection member 17 and the second detection member 43 may be both an optical sensor, an ultrasonic sensor, or a Hall sensor.

For example, in the illustrated embodiment, the balancer 13 includes a controller 31. The controller 31 is connected to the first detection member 17 and the second detection member 43, and the controller 31 is configured to centrally process the detection results of the first detection member 17 and the second detection member 43. Thus, the controller 31 may be directly arranged on the balancer 13, without additionally arranging other controllers 31 on the balancing ring 11.

Referring to FIG. 11, a household appliance 200 is provided according to an embodiment of the present disclosure. The household appliance 200 includes a cavity 51 and the balance assembly 100 as described in any of the above embodiments. The cavity 51 has a rotation axis L. The balance assembly 100 is mounted in the cavity 51, and a central axis of a balancing ring 11 is parallel to or coincident with the rotation axis L of the cavity 51.

In the above household appliance 200, the rotating member 21 may drive the balancer 13 to move within the chamber 19. The first detection member 17 may detect the number of times of the identification member 15 passing through the first detection member 17, and the number of times of the identification member 15 passing through the first detection member 17 may be used to determine the position of the balancer 13.

It can be understood that, when the central axis of the balancing ring 11 is parallel to or coincident with the rotation axis L of the cavity 51, the balancer 13 can reduce the vibration of the cavity 51.

In the present disclosure, the household appliance 200 may be provided with a vibration sensor (not shown) and a main controller 50. The vibration sensor may be configured to detect the vibration information of the cavity 51 or the vibration information of other components connected to the cavity 51. The main controller 50 may control, based on the vibration information, the movement of the balancer 13 to adjust the specific position of the balancer 13 in the cavity 19, to counteract or reduce the vibration of the cavity 51.

In some embodiments, the main controller 50 may be in communication with the controller 31 of the balance assembly 100 in a wired or wireless manner, to transmit a current state signal and movement signal of the balancer 13 and the like. The current state signal of the balancer 13 includes a current position of the balancer 13, whether the balancer 13 is in a moving state, a communication connection state, and the like. The main controller 50 may transmit the movement signal to the controller 31, and based on the movement signal, the controller 31 controls the movement of the balancer 13. The controller 31 may transmit the current state signal of the balancer 13 to the main controller 50, and the current state signal of the balancer 13 is received and analyzed by the main controller 50 to obtain the current position, movement state and communication connection state, and the like of the balancer 13.

It should be noted that the household appliance 200 may be a laundry appliance such as a washing machine or a dryer, or other household appliances 200 having a rotatable cavity 51. Referring to FIG. 11, the household appliance 200 is a washing machine for washing clothes. The cavity 51 is an inner drum, and the inner drum is rotatably disposed in the outer drum 53. Clothes are placed in the inner drum. During the working of the washing machine (such as a dehydration stage), the inner drum rotates at a high speed, and the clothes in the inner drum may be unevenly distributed, which may result in an eccentric vibration. When the inner drum rotates at high speed, the washing machine may vibrate strenuously. Since the vibration of the inner drum may be transmitted to the outer drum 53, by detecting the vibration information of the outer drum 53, it may be determined whether the inner drum is in a state of eccentric vibration. The balancing ring 11 is connected and fixed to the inner drum can rotate together with the inner drum. Therefore, the movement of the balancer 13 in the chamber 19 may be controlled based on the vibration information to offset or reduce the eccentric mass during the rotation of the inner drum.

In addition, in order to further reduce the transmission of the vibration inside the household appliance 200 to the outside, the outer drum 53 may be connected to a mounting plate 55 through a vibration damping structure 54, and the mounting plate 55 may be fixed on a housing bottom plate of the household appliance 200. The vibration damping structure 54 may adopt vibration damping methods such as spring and hydraulic pressure.

Throughout the specification, description with reference to "an embodiment," "some embodiments," "a certain embodiment," "illustrative embodiments," "an example," "a specific example," or "some examples," means that a particular feature, structure, material, or characteristic described in connection with the embodiment or example is included in at least an embodiment or example of the present disclosure. The appearances of the above phrases in various places throughout the present disclosure are not necessarily referring to the same embodiment or example of the present disclosure. Furthermore, the particular features, structures, materials, or characteristics described here may be combined in any suitable manner in one or more embodiments or examples.

What is claimed is:

1. A balance assembly in a household appliance, the balance assembly being provided in an inner drum of the household appliance and being configured to rotate together with the inner drum, the balance assembly comprising:

a balancing ring having a chamber defined therein;

a balancer movably arranged in the chamber and comprising a rotating member and a driving member, wherein the driving member is connected to the rotating member and is configured to drive the rotating member to rotate to drive a movement of the balancer within the chamber;

an identificator provided in the rotating member of the balancer;

a first detector provided in the balancer and configured to detect position of the identificator;

a calibration member arranged on an inner wall of the chamber of the balancing ring; and a second detector disposed on the balancer and configured to detect position of the calibration member when the second detector passes through the calibration member;

wherein the identificator and the first detector are configured for relative movement during the movement of the balancer;

wherein the calibration member and the second detector are configured for relative movement during the movement of the balancer;

wherein the first detector is configured to detect a number of times of the identificator passing through the first detector, the number of times of the identificator passing through the first detector being related to a position of the balancer.

2. The balance assembly according to claim 1, wherein the rotating member comprises a gear, wherein the chamber comprises a first inner wall having a ring gear portion disposed thereon, the gear meshing with the ring gear portion, and wherein the identificator is a tooth of the gear or a tooth of the ring gear portion.

3. The balance assembly according to claim 1, further comprising:

a controller electrically connected to the first detector, wherein the chamber has an initial position, and wherein the controller is configured to determine the position of the balancer based on the initial position and the number of times of the identificator passing through the first detector.

4. The balance assembly according to claim 1, further comprising:

a first guide member disposed on the balancer; and a second guide member, wherein the chamber comprises a first inner wall, and a second inner wall opposite to the first inner wall, wherein the second guide member is disposed on the second inner wall, and wherein the first guide member is connected to the second guide member to guide the movement of the balancer.

5. The balance assembly of claim 4, wherein the first guide member comprises a roller connected to the second guide member.

6. The balance assembly according to claim 1, wherein the first detector or the second detector is an optical sensor, an ultrasonic sensor or a Hall sensor.

7. The balance assembly according to claim 1, wherein multiple calibration members are arranged at intervals on the inner wall of the chamber.

8. The balance assembly according to claim 7, wherein each of the multiple calibration members comprises a different number of calibration portions such that the second detector triggers different number of pulse signals after passing through different numbers of calibration portions.

9. A household appliance, comprising:

an inner drum and an outer drum, the inner drum being rotatably disposed in the outer drum, the inner drum having a rotation axis; and a balance assembly provided in the inner drum and configured to rotate with the inner drum;

the balance assembly comprising:

a balancing ring having a chamber defined therein, a central axis of the balancing ring being parallel to or coincident with the rotation axis of the inner drum;

a balancer movably arranged in the chamber and comprising a rotating member and a driving member, wherein the driving member is connected to the rotating member and is configured to drive the rotating member to rotate to drive a movement of the balancer within the chamber;

an identificator provided in the rotating member of the balancer; and a first detector provided in the balancer;

a calibration member arranged on an inner wall of the chamber of the balancing ring; and a second detector disposed on the balancer and configured to detect position of the calibration member when the second detector passes through the calibration member;

wherein the calibration member and the second detector are configured for relative movement during the movement of the balancer;

wherein the balance assembly is configured to cause a relative movement between the identificator and the first detector during the movement of the balancer, wherein the first detector is configured to detect a number of times of the identificator passing through the first detector, the number of times of the identificator passing through the first detector being related to a position of the balancer.

10. The household appliance according to claim 9, wherein the rotating member comprises a gear, wherein the chamber comprises a first inner wall having a ring gear portion disposed thereon, the gear meshing with the ring gear portion, and wherein the identificator is a tooth of the gear or a tooth of the ring gear portion.

11. The household appliance according to claim 9, further comprising:

a controller electrically connected to the first detector, wherein the chamber has an initial position, and wherein the controller is configured to determine the position of the balancer based on the initial position and the number of times of the identificator passing through the first detector.

12. The household appliance according to claim 9, further comprising:

a first guide member disposed on the balancer; and a second guide member, wherein the chamber comprises a first inner wall, and a second inner wall opposite to the first inner wall, wherein the second guide member is disposed on the second inner wall, and wherein the first guide member is connected to the second guide member to guide the movement of the balancer.

13. The household appliance according to claim 12, wherein the first guide member comprises a roller connected to the second guide member.

14. The household appliance according to claim 9, wherein the first detector or the second detector is an optical sensor, an ultrasonic sensor or a Hall sensor.

15. The household appliance according to claim 9, wherein multiple calibration members are arranged at intervals on the inner wall of the chamber.

16. The household appliance according to claim 15, wherein each of the multiple calibration members comprises a different number of calibration portions such that the second detector triggers different number of pulse signals after passing through different numbers of calibration portions.

* * * * *